US008882479B2

(12) United States Patent
Asai et al.

(10) Patent No.: US 8,882,479 B2
(45) Date of Patent: Nov. 11, 2014

(54) INTEGRATED-INVERTER ELECTRIC COMPRESSOR

(75) Inventors: Masahiko Asai, Aichi (JP); Makoto Hattori, Aichi (JP); Hiroyuki Kamitani, Aichi (JP); Koji Nakano, Aichi (JP); Koji Toyama, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 767 days.

(21) Appl. No.: 12/745,805

(22) PCT Filed: Nov. 13, 2008

(86) PCT No.: PCT/JP2008/070654

§ 371 (c)(1),
(2), (4) Date: Jun. 2, 2010

(87) PCT Pub. No.: WO2009/075157

PCT Pub. Date: Jun. 18, 2009

(65) Prior Publication Data

US 2010/0247349 A1 Sep. 30, 2010

(30) Foreign Application Priority Data

Dec. 13, 2007 (JP) ..... 2007-322281

(51) Int. Cl.

| | |
|---|---|
| ***F04B 39/12*** | (2006.01) |
| ***F04B 35/04*** | (2006.01) |
| ***F04C 28/08*** | (2006.01) |
| *F04C 29/04* | (2006.01) |

(52) U.S. Cl.

CPC ..... *F04C 28/08* (2013.01); *F04B 35/04* (2013.01); *F04C 2240/808* (2013.01); *F04C 29/04* (2013.01); *F04B 39/12* (2013.01); *F04B 2203/0204* (2013.01)

USPC ..... 417/423.14; 417/410.1; 310/68 R; 310/72; 310/71; 310/89 CPC ..... F04B 17/03

USPC ..... 417/410.1, 423.14; 310/68 R, 72, 71, 89

See application file for complete search history.

(58) Field of Classification Search

(56) References Cited

U.S. PATENT DOCUMENTS 5,959,377 A * 9/1999 Horng ..... 310/40 MM
6,354,674 B1 * 3/2002 Iwamoto et al. ..... 303/119.3

(Continued)

FOREIGN PATENT DOCUMENTS

JP 2004-225580 A 8/2004
JP 2006-233820 A 9/2006

(Continued)

OTHER PUBLICATIONS

Japanese Decision to Grant a Patent dated Sep. 11, 2012, issued in corresponding Japanese Patent Application No. 2007-322281, w/ English translation.

(Continued)

*Primary Examiner* — Charles Freay
*Assistant Examiner* — Christopher Bobish
(74) *Attorney, Agent, or Firm* — Westerman, Hattori, Daniels & Adrian, LLP

(57) ABSTRACT

A common mode coil can be installed without having to increase the planar area for an inverter accommodating section so that high performance and size reduction and compactness of an inverter device can be achieved. In an integrated-inverter electric compressor (1) in which an outer periphery of a cylindrical housing (2) is provided with an inverter accommodating section (4) in which an inverter device (20) that includes high-voltage components, such as an inverter board (21), a smoothing capacitor (23), an inductor coil (24), and a common mode coil (30); a terminal block (26) connected with a high-voltage cable; and a bus bar assembly (32) for electrical wiring between these electrical components is installed, the inverter accommodating section (4) is provided with an outward extending portion (9) extending outward from one end of the cylindrical housing (2), the terminal block (26) is disposed at one side of the outward extending portion (9), and a coil installation site (12), where the common mode coil (30) is disposed, is formed integrally with the outward extending portion (9) and extends downward below the terminal block (26).

14 Claims, 5 Drawing Sheets

(56) References Cited

U.S. PATENT DOCUMENTS

| | | | | |
|---|---|---|---|---|
| 6,564,576 | B2 * | 5/2003 | Shibuya | 62/505 |
| 6,875,029 | B2 * | 4/2005 | Kawabata et al. | 439/76.2 |
| 7,207,187 | B2 * | 4/2007 | Funahashi et al. | 62/228.4 |
| 7,621,367 | B2 * | 11/2009 | Tominaga et al. | 180/444 |
| 7,972,123 | B2 * | 7/2011 | Koide et al. | 417/411 |
| 8,118,564 | B2 * | 2/2012 | Enami et al. | 417/44.1 |
| 2003/0200761 | A1 * | 10/2003 | Funahashi et al. | 62/228.4 |
| 2004/0052660 | A1 * | 3/2004 | Kimura et al. | 417/410.3 |
| 2005/0063836 | A1 * | 3/2005 | Kimura et al. | 417/313 |
| 2005/0167183 | A1 * | 8/2005 | Tominaga et al. | 180/444 |
| 2007/0231165 | A1 | 10/2007 | Koide et al. | |

FOREIGN PATENT DOCUMENTS

| | | | |
|---|---|---|---|
| JP | 2006-316755 | A | 11/2006 |
| JP | 2007-162701 | A | 6/2007 |
| JP | 2007-263061 | A | 10/2007 |

OTHER PUBLICATIONS

International Search Report of PCT/JP2008/070654, mailing date of Jan. 13, 2009.

* cited by examiner

INTEGRATED-INVERTER ELECTRIC COMPRESSOR

TECHNICAL FIELD

The present invention relates to an integrated-inverter electric compressor in which an inverter accommodating section is provided on an outer periphery of a cylindrical housing containing an electric motor and a compression mechanism, and the inverter accommodating section accommodates an inverter device.

BACKGROUND ART

In recent years, various kinds of integrated-inverter electric compressors formed by integrally fitting inverter devices therein have been proposed as compressors for air conditioners mounted in vehicles. Generally, such integrated-inverter electric compressors for vehicle air conditioners are configured such that an inverter accommodating section (i.e., an inverter box) is provided on an outer periphery of a housing containing an electric motor and a compression mechanism, and an inverter device that converts direct-current power supplied from a high-voltage power source to three-phase alternating-current power and feeds the three-phase alternating-current power to the electric motor is fitted inside the inverter accommodating section, so that the rotation speed of the electric compressor can be varied according to the air-conditioning load.

Examples of integrated-inverter electric compressors having the above configuration are described in Patent Documents 1 and 2, in which the inverter device includes an inverter board including a power board having mounted thereon power semiconductor switching devices or the like that receive high voltage and a control board or the like having mounted thereon a control communication circuit, such as a CPU, that operates at low voltage; high-voltage components such as an inductor coil and a smoothing capacitor that minimize switching noise and reduce current ripple of the inverter; a power-supply terminal connected with a high-voltage cable; and a bus bar assembly for electrical wiring between these electrical components.

The electrical components constituting the aforementioned inverter device are accommodated within the inverter accommodating section (i.e., inverter box or outer shell) provided on the outer periphery of the housing of the electric compressor in view of vibration-proof and heat resisting properties so that the electrical components are made as compact as possible and can be electrically wired as readily as possible and also so that heat-generating components, such as the power semiconductor switching devices and the high-voltage components, can be properly cooled.

Patent Document 1: The Publication of Japanese Patent No. 3827158

Patent Document 2: Japanese Unexamined Patent Application, Publication No. 2006-233820

DISCLOSURE OF INVENTION

As engine compartments of vehicles are becoming more and more dense, further size reduction and compactness of compressors for vehicle air conditioners are desired for ensuring the mountability thereof. For this reason, the demand for compactness of the inverter accommodating section containing the inverter device is still extremely high even for an integrated-inverter electric compressor having an inverter device integrally fitted therein. On the other hand, there is also a demand for, for example, reducing common mode noise of the inverter device. In this case, a common mode coil is necessary, and the inverter accommodating section needs to be made larger to ensure installation space for the common mode coil, adding constraints to achieving size reduction and compactness of the integrated-inverter electric compressor. Installation of a common mode coil can lead to problems such as the inability to optimally arrange other electrical components.

The present invention has been made in view of these circumstances, and an object thereof is to provide an integrated-inverter electric compressor that allows a common mode coil to be installed therein without having to increase the planar area for an inverter accommodating section and that achieves high performance of an inverter device and size reduction and compactness of an inverter accommodating section containing the inverter device so as to allow for enhanced mountability of the electric compressor.

In order to achieve the aforementioned object, an integrated-inverter electric compressor according to the present invention employs the following solutions.

Specifically, a first aspect of an integrated-inverter electric compressor according to the present invention is such that, in an integrated-inverter electric compressor in which an inverter accommodating section is provided on an outer periphery of a cylindrical housing containing an electric motor and a compression mechanism, and the inverter accommodating section accommodates an inverter device that includes high-voltage components, such as an inverter board, a smoothing capacitor, an inductor coil, and a common mode coil; a terminal block connected with a high-voltage cable; and a bus bar assembly including a plurality of bus bars for electrical wiring between these electrical components, the inverter accommodating section is provided with an outward extending portion extending outward from one end of the cylindrical housing, the terminal block is disposed at one side of the outward extending portion, and a coil installation site, where the common mode coil is disposed, is formed integrally with the outward extending portion and extends downward below the terminal block.

In an integrated-inverter electric compressor, a smoothing capacitor and an inductor coil are generally provided for minimizing switching noise and for reducing current ripple of the inverter, but in addition to the installation of these components, installation of a common mode coil is also sometimes desired for reducing common mode noise. However, in order to install a common mode coil, the inverter accommodating section needs to be made larger, adding constraints to achieving size reduction and compactness of the integrated-inverter electric compressor.

In the first aspect, the inverter accommodating section is provided with the outward extending portion extending outward from one end of the cylindrical housing, the terminal block is disposed at one side of the outward extending portion, and the coil installation site, where the common mode coil is disposed, is formed integrally with the outward extending portion and extends downward below the terminal block, so that the common mode coil that reduces common mode noise can be installed in the coil installation site formed integrally with the outward extending portion and extending downward below the terminal block. Therefore, without having to increase the planar area for the inverter accommodating section, the common mode coil can be installed while maintaining the same planar area of the inverter accommodating section as that when a common mode coil is not provided. Accordingly, in addition to achieving high performance of the inverter device, size reduction and compactness of the inverter accommodating section containing the inverter device are also achieved, thereby enhancing the mountability of the integrated-inverter electric compressor.

Furthermore, a second aspect of an integrated-inverter electric compressor according to the present invention is such that, in an integrated-inverter electric compressor in which an inverter accommodating section is provided on an outer periphery of a cylindrical housing containing an electric motor and a compression mechanism, and the inverter accommodating section accommodates an inverter device that includes high-voltage components, such as an inverter board, a smoothing capacitor, an inductor coil, and a common mode coil; a terminal block connected with a high-voltage cable; and a bus bar assembly including a plurality of bus bars for electrical wiring between these electrical components, the inverter accommodating section is provided with an outward extending portion extending outward from one end of the cylindrical housing, an area in the inverter accommodating section that corresponds to the outer periphery of the cylindrical housing serves as an installation site for the inverter board, the outward extending portion serves as a high-voltage-component installation site where the smoothing capacitor and the inductor coil are disposed, one side of the high-voltage-component installation site in the outward extending portion is designated as an installation site for the terminal block, and a coil installation site where the common mode coil is disposed is formed below the terminal-block installation site.

According to the second aspect, the inverter accommodating section is provided with the outward extending portion extending outward from one end of the cylindrical housing, the inverter board is disposed in the area in the inverter accommodating section that corresponds to the outer periphery of the cylindrical housing, the smoothing capacitor and the inductor coil are disposed in the outward extending portion, one side of the outward extending portion is designated as the installation site for the terminal block, and the coil installation site where the common mode coil is disposed is formed below the terminal-block installation site so as to dispose the common mode coil therein, so that the common mode coil for reducing common mode noise can be installed in the coil installation site formed in a space below the terminal block. Therefore, the common mode coil can be added while maintaining the same planar area of the inverter accommodating section as that when accommodating an inverter device including an inverter board, a smoothing capacitor, an inductor coil, and a terminal block. Accordingly, in addition to achieving high performance of the inverter device, size reduction and compactness of the compact inverter accommodating section containing the inverter device are also achieved, thereby enhancing the mountability of the integrated-inverter electric compressor.

Furthermore, the integrated-inverter electric compressor of the second aspect may be such that, in the aforementioned integrated-inverter electric compressor, of the smoothing capacitor and the inductor coil disposed along one end of the cylindrical housing, the terminal-block installation site and the coil installation site are provided at one side of the high-voltage-component installation site that is adjacent to the smoothing capacitor.

According to the second aspect, of the smoothing capacitor and the inductor coil disposed along one end of the cylindrical housing, the terminal-block installation site and the coil installation site are provided at one side of the high-voltage-component installation site that is adjacent to the smoothing capacitor so that the bus bar assembly for electrical wiring between the electrical components, i.e., the common mode coil, the inductor coil, the smoothing capacitor, and the inverter board connected with a high-voltage line in that order in the downstream direction from the terminal block, can have a simple configuration. Thus, the installation space of the bus bar assembly can be minimized, thereby contributing to size reduction and compactness of the inverter device and the accommodating section therefor.

Furthermore, the integrated-inverter electric compressor of the second aspect may be such that, in the aforementioned integrated-inverter electric compressor, the terminal block and the common mode coil are disposed at two levels in the vertical direction in the terminal-block installation site and the coil installation site.

According to the second aspect, because the terminal block and the common mode coil are disposed at two levels in the vertical direction in the terminal-block installation site and the coil installation site, the common mode coil can be installed within a projection area of the terminal-block installation site as long as there is no significant difference in planar dimensions between the terminal block and the common mode coil. In consequence, the planar area of the inverter accommodating section can be made substantially the same regardless of the presence or absence of the common mode coil, and can thus be minimized.

Furthermore, the integrated-inverter electric compressor of the second aspect may be such that, in the aforementioned integrated-inverter electric compressor, the common mode coil is disposed such that, of four enameled wires extending from the coil, two of the enameled wires on an upstream side are routed vertically along one side of the terminal block, two of the enameled wires on a downstream side are routed vertically along another side of the terminal block, and each enameled wire is connected between two of the bus bars connected to the terminal block.

According to the second aspect, because the common mode coil is disposed such that, of the four enameled wires, two of the enameled wires on the upstream side are routed vertically along one side of the terminal block and two of the enameled wires on the downstream side are routed vertically along another side of the terminal block, and each enameled wire is connected between two of the bus bars connected to the terminal block, the four enameled wires extending from the common mode coil can be connected between the two bus bars by simply extending the four enameled wires upward along both sides of the terminal block. This facilitates routing of the four enameled wires, as well as welding to the bus bars, thereby allowing for improved assembly and productivity.

Furthermore, the integrated-inverter electric compressor of the second aspect may be such that, in the aforementioned integrated-inverter electric compressor, ends of the bus bars of the bus bar assembly are provided with connectors that retain ends of enameled wires extending from the inductor coil and the common mode coil.

According to the second aspect, because the ends of the bus bars of the bus bar assembly are provided with connectors that retain the ends of the enameled wires extending from the inductor coil and the common mode coil, when the enameled wires and the bus bars are to be joined together by welding, the welding process can be performed in a state where the ends of the enameled wires are retained to the connectors at the bus-bar ends. This allows for reduction of components for guiding the ends of the enameled wires to the connectors of the bus bars, as well as enhancement in positioning accuracy of welding points where the enameled wires are welded to the bus bars. Accordingly, welding workability is improved and the weld quality and weld strength are also improved, thereby increasing product quality and reliability.

Furthermore, the integrated-inverter electric compressor of the second aspect may be such that, in the high-voltage-component installation site in the aforementioned integrated-inverter electric compressor, the smoothing capacitor is disposed on an extension line of a P-N terminal provided at one side of the inverter board, and a bus bar of the bus bar assembly that connects between the smoothing capacitor and the P-N terminal is disposed with a minimal distance along the extension line.

According to the second aspect, in the high-voltage-component installation site, the smoothing capacitor is disposed on the extension line of the P-N terminal provided at one side of the inverter board and the bus bar in the bus bar assembly that connects between the smoothing capacitor and the P-N terminal is disposed with a minimal distance along the extension line, and therefore, current ripple in the inverter can be reduced as much as possible. This minimizes voltage fluctuations and the like and thus stabilizes the performance of the inverter.

Furthermore, the integrated-inverter electric compressor of the second aspect may be such that, in the aforementioned integrated-inverter electric compressor, the one end of the cylindrical housing is provided with a refrigerant intake port, and the high-voltage-component installation site and the coil installation site are at least partially connected to a surface of the one end of the cylindrical housing provided with the refrigerant intake port.

According to the second aspect, because the high-voltage-component installation site and the common mode coil are partially connected to the one end surface of the cylindrical housing provided with the refrigerant intake port, the cooling effect using low-temperature intake refrigerant gas on the smoothing capacitor, the inductor coil, and the common mode coil disposed in the high-voltage-component installation site and the coil installation site can be increased. Accordingly, the heat-resisting performance of the smoothing capacitor, the inductor coil, the common mode coil, and the like is enhanced, thereby minimizing performance degradation.

According to the present invention, the common mode coil is disposed in the coil installation site formed integrally with the outward extending portion and extending downward below the terminal block so that, without having to increase the planar area for the inverter accommodating section, the common mode coil can be installed while maintaining the same planar area of the inverter accommodating section as that when a common mode coil is not provided, thereby achieving high performance of the inverter device as a result of reduction of common mode noise, as well as size reduction and compactness of the inverter accommodating section containing the inverter device so as to allow for enhanced mountability of the integrated-inverter electric compressor.

EXPLANATION OF REFERENCE SIGNS

Figure 1:
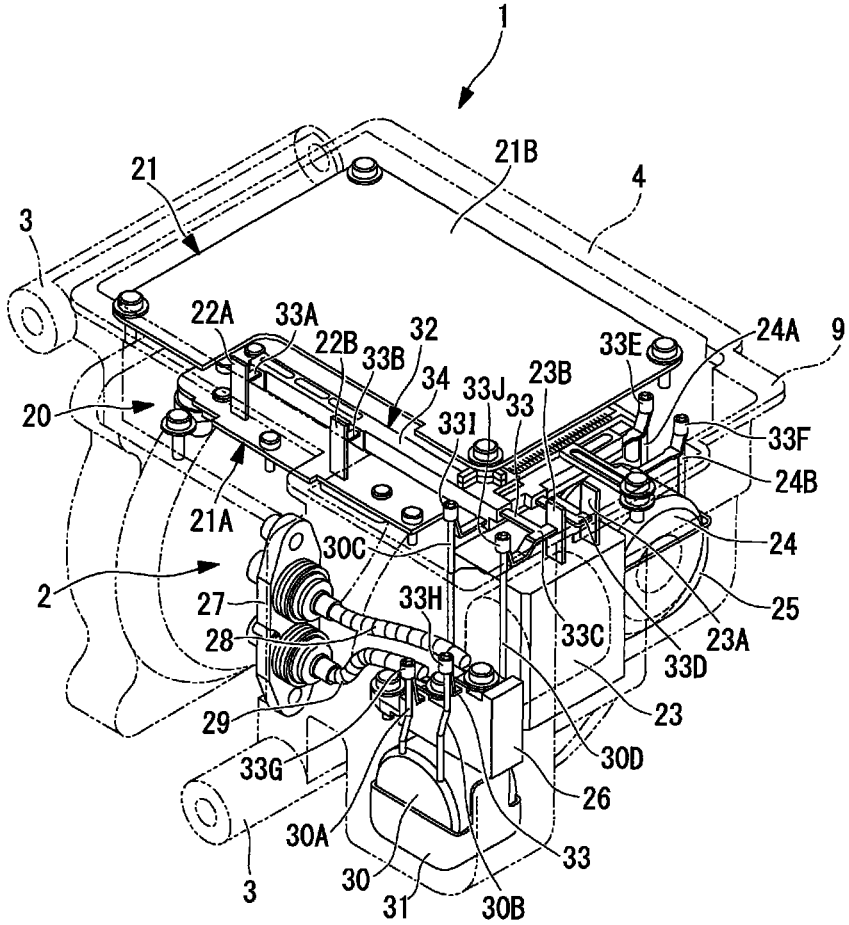
FIG. 1 is a perspective view showing the arrangement of electrical components that constitute an inverter device of an integrated-inverter electric compressor according to an embodiment of the present invention.

1: integrated-inverter electric compressor
2: cylindrical housing (motor housing)
4: inverter accommodating section
5: inverter-board installation site
9: outward extending portion
10: high-voltage-component installation site
11: terminal-block installation site
12: coil installation site
20: inverter device
21: inverter board
22A, 22B: P-N terminals
23: smoothing capacitor (head capacitor, high-voltage component)
24: inductor coil (high-voltage component)
24A, 24B: enameled wires
26: terminal block
28, 29: high-voltage cables
30: common mode coil (high-voltage component)
30A, 30B, 30C, 30D: enameled wires
32: bus bar assembly
33: bus bar
33E, 33F, 33G, 33H, 33I, 33J: connectors for retaining enameled wires

BEST MODE FOR CARRYING OUT THE INVENTION

An embodiment of the present invention will be described below with reference to FIGS. 1 to 5.

FIG. 1 is a perspective view showing the arrangement of electrical components that constitute an inverter device of an integrated-inverter electric compressor according to an embodiment of the present invention.

An integrated-inverter electric compressor 1 has a cylindrical housing 2 constituting an outer shell thereof. The cylindrical housing 2 is formed by tightly fixing a motor housing that accommodates an electric motor and a compressor housing that accommodates a compression mechanism together by means of bolts, and these housings are both formed by aluminum die-casting. In this embodiment, only the motor housing side is shown.

The electric motor (not shown) and the compression mechanism that are accommodated within the cylindrical housing 2 are linked to each other by means of a motor shaft, and the compression mechanism is configured to be driven by rotating the electric motor. A rear end (i.e., the right side in FIG. 1) of the cylindrical housing (motor housing) 2 is provided with a refrigerant intake port (not shown), and low-pressure refrigerant gas taken into the cylindrical housing 2 through this refrigerant intake port flows in the motor-shaft direction around the electric motor and is subsequently taken in by the compression mechanism so as to be compressed. High-temperature high-pressure refrigerant gas compressed by the compression mechanism is discharged into the cylindrical housing (compressor housing) 2 and is subsequently delivered outward from a discharge port (not shown) provided at a front end of the cylindrical housing (compressor housing) 2.

The cylindrical housing 2 is provided with mounting legs 3 at a total of three locations, namely, for example, a lower part of the rear end, a lower part of the front end, and an upper part.

The integrated-inverter electric compressor 1 is mounted in a vehicle by being fixed to a cantilevered bracket provided on a sidewall or the like of a vehicle engine by means of bolts or the like using these mounting legs 3. Normally, the integrated-inverter electric compressor 1 is supported in a cantilevered fashion at three upper and lower positions such that one side surface thereof is disposed along the cantilevered bracket while the motor-shaft direction is oriented in the front-rear direction or the left-right direction of the vehicle.

Figure 2:
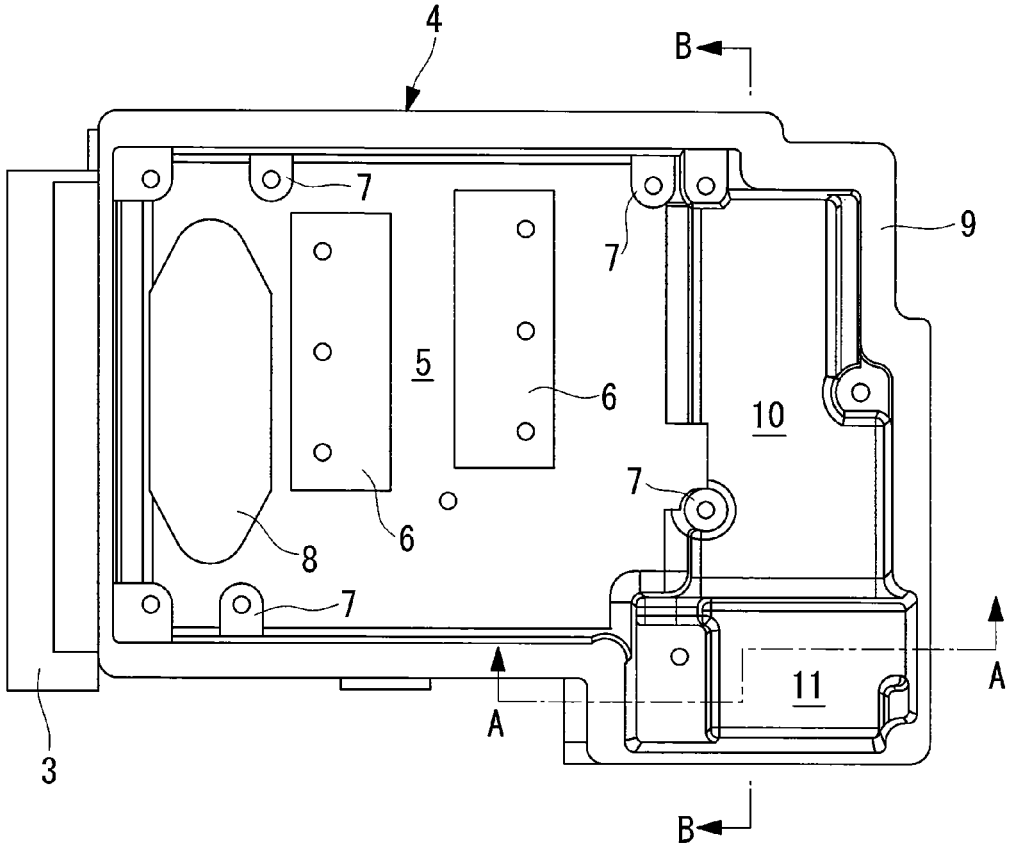
FIG. 2 is a plan view of a motor housing in the integrated-inverter electric compressor shown in FIG. 1.
Figure 3:
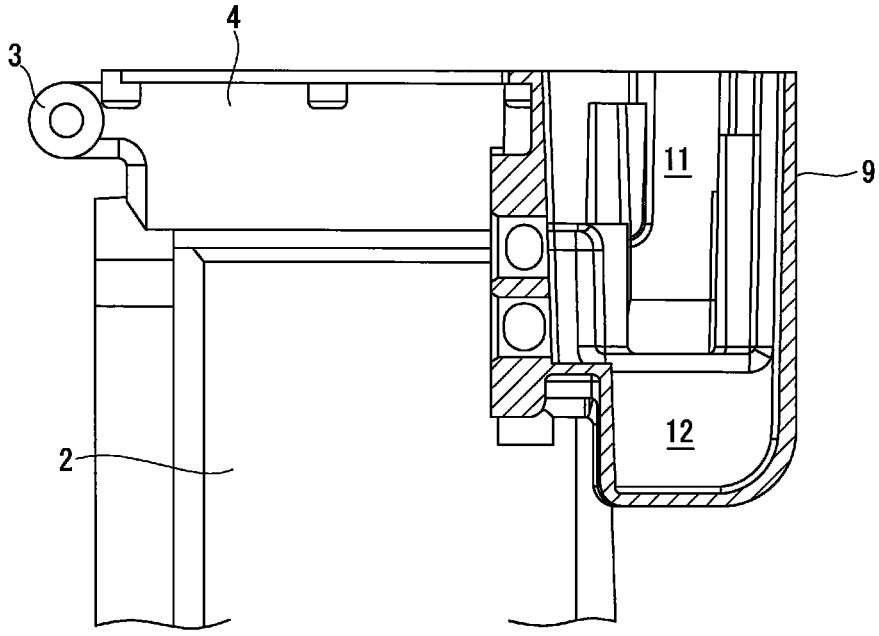
FIG. 3 is a sectional view of the motor housing, taken along line A-A in FIG. 2.
Figure 4:
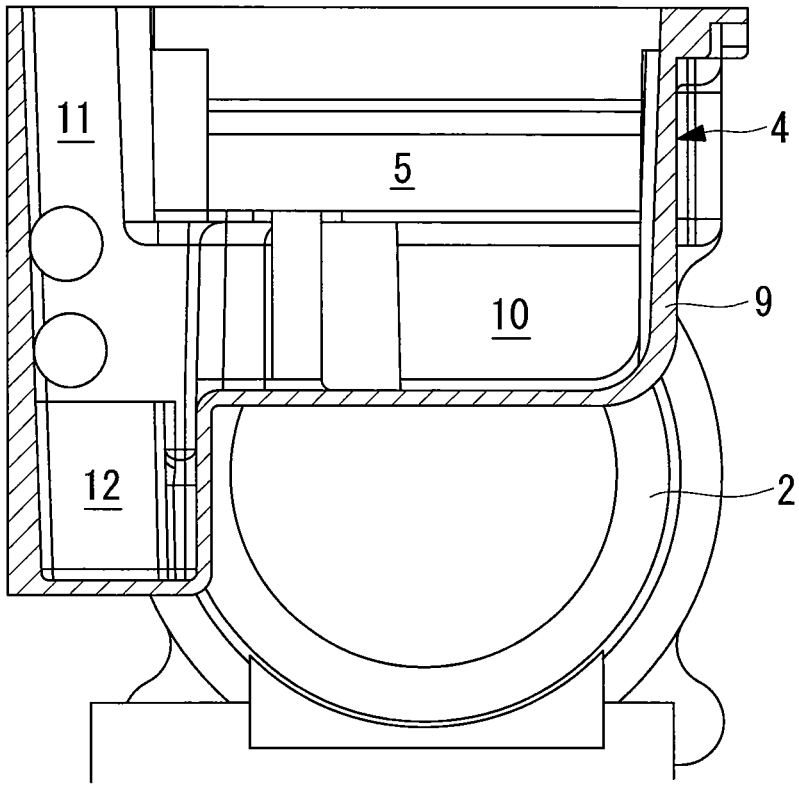
FIG. 4 is a sectional view of the motor housing, taken along line B-B in FIG. 2.

A box-shaped inverter accommodating section 4 with a substantially rectangular planar shape is integrally formed at an upper part of an outer peripheral surface of the cylindrical housing 2. The inverter accommodating section 4 has a box structure with an open upper surface and surrounded by peripheral walls of a predetermined height, and after an inverter device 20 to be described later is accommodated within the inverter accommodating section 4, the upper surface is configured to be hermetically closed by means of a plate-shaped cover member (not shown). As shown in FIGS. 2 to 4, a part of the inverter accommodating section 4 that corresponds to the outer peripheral surface of the cylindrical housing 2 serves as an inverter-board installation site 5 with a relatively small depth, and the bottom surface thereof is provided with installation surfaces 6 for installing semiconductor switching devices such as IGBTs (not shown), installation bosses 7 for installing an inverter board 21, and the like, as well as an installation hole 8 for installing glass-sealed terminals (not shown) that feed three-phase alternating-current power converted by the inverter device 20 from the inverter device 20 to the electric motor provided inside the cylindrical housing 2.

The inverter accommodating section 4 is provided with an outward extending portion 9 that extends outward from one end surface of the cylindrical housing 2, and this outward extending portion has a greater depth relative to that of the inverter-board installation site 5 and serves as a high-voltage-component installation site 10 for high-voltage components, such as a smoothing capacitor (head capacitor) 23 and an inductor coil 24 to be described later. One side of the high-voltage-component installation site 10 is designated as an installation site 11 for a terminal block 26 to be described later, and a coil installation site 12 for a common mode coil 30 to be described later extends downward from below the terminal-block installation site 11 so as to have a depth greater than that of the high-voltage-component installation site 10.

The high-voltage-component installation site 10 and the coil installation site 12 extending downward therefrom, which are formed by the outward extending portion 9, are provided so as to at least partially extend from one end surface of the cylindrical housing 2 provided with the refrigerant intake port and connect with a housing wall thereof. This configuration facilitates the transmission of the cooling energy of refrigerant gas taken into one end of the cylindrical housing 2 towards the high-voltage-component installation site 10 and the coil installation site 12.

As shown in FIG. 1, the inverter accommodating section 4 having the above configuration accommodates various kinds of electrical components that constitute the inverter device 20. Specifically, in the inverter-board installation site 5, the inverter board 21, which includes a power board 21A having mounted thereon a plurality of semiconductor switching devices, such as IGBTs, circuits thereof, and the like installed on the installation surfaces 6, and a CPU board 21B having mounted thereon a control communication circuit etc., such as a CPU, driven at low voltage, is fixed to the installation bosses 7. The power board 21A is provided with output terminals (U-V-W terminals) (not shown) connected to the glass-sealed terminals installed in the installation hole 8 and configured to be connected to the electric motor in the cylindrical housing 2. The power board 21A is provided with a pair of upward-extending P-N terminals 22A and 22B with a predetermined distance therebetween at one side of the board.

In the high-voltage-component installation site 10, the smoothing capacitor (head capacitor) 23, whose exterior is enclosed by a casing, and the inductor coil 24 accommodated within a plastic casing 25 are fixed side by side along one end surface of the cylindrical housing 2. In this embodiment, the smoothing capacitor 23 is provided adjacent to the front side of the drawing which is closer to the pair of P-N terminals 22A and 22B disposed with a predetermined distance therebetween at one side of the power board 21A. The smoothing capacitor 23 is provided with two upward-extending terminals 23A and 23B, and the inductor coil 24 is provided with two upward-extending enameled wires 24A and 24B.

The terminal block 26 is fixed in the terminal-block installation site 11 and is connected to two high-voltage cables 28 and 29 via a connector 27 installed on a sidewall of the inverter accommodating section 4 at the front side of the terminal-block installation site 11. The connector 27 is configured to be connected to a high-voltage cable that feeds high-voltage direct-current power from a power-supply unit (not shown).

The common mode coil 30 is accommodated in a plastic casing 31 and is fixed in the coil installation site 12 formed below the terminal block 26. The common mode coil 30 is provided with four upward-extending enameled wires 30A, 30B, 30C, and 30D. The two upstream-side enameled wires 30A and 30B are routed by being extended along a side surface of the terminal block 26 adjacent to the front side of the drawing to a position slightly above the terminal block 26, whereas the two downstream-side enameled wires 30C and 30D are routed by being extended along a side surface of the terminal block 26 adjacent to the rear side of the drawing to the same height position as the terminals 23A and 23B of the smoothing capacitor 23 located higher than the terminal block 26.

Figure 5:
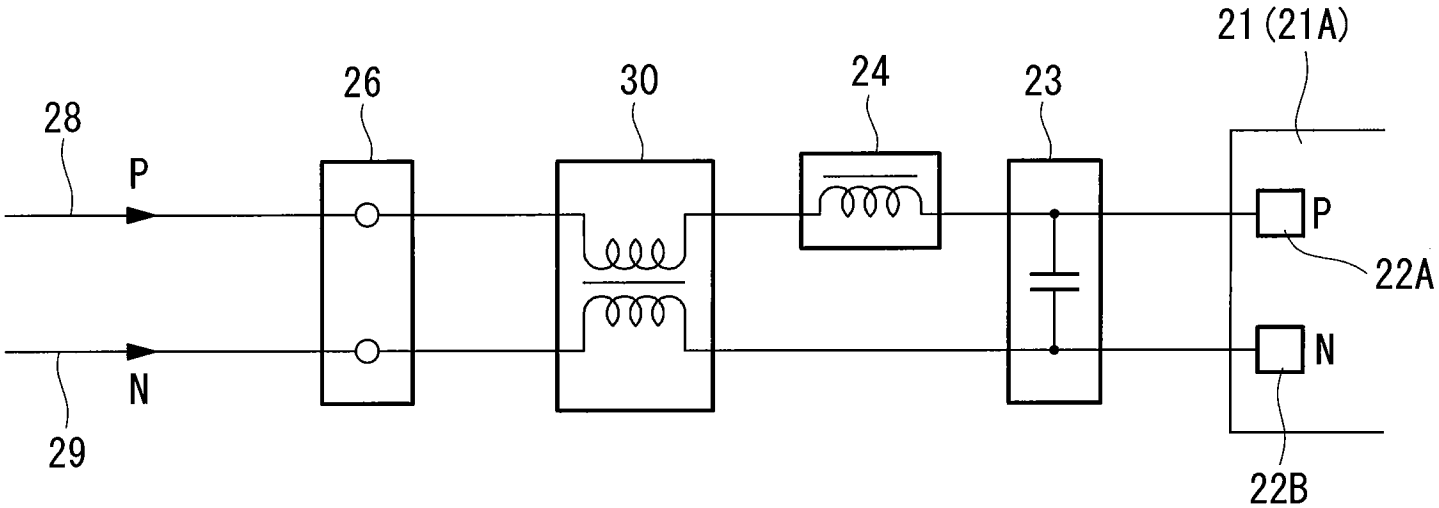
FIG. 5 is an electrical wiring diagram of the inverter device of the integrated-inverter electric compressor shown in FIG. 1.

As shown in FIG. 5, the high-voltage cables 28 and 29, the terminal block 26, the common mode coil 30, the inductor coil 24, the smoothing capacitor 23, and the power board 21A (P-N terminals 22A and 22B) of the inverter board 21 are connected with high-voltage lines, continuing from the high-voltage cables 28 and 29, in that order in the downstream direction from the terminal block 26 to the P-N terminals 22A and 22B of the power board 21A. The electrical wiring therebetween is implemented by means of a bus bar assembly 32.

The bus bar assembly 32 is formed by integrating a plurality of bus bars 33 used for the electrical wiring between the aforementioned electrical components 21, 23, 24, 26, and 30 by insert molding using an insulating resinous material 34 and is substantially L-shaped. Each of the bus bars 33 is provided with a connector for connecting to the corresponding electrical component 21, 23, 24, 26, or 30 by welding. In other words, the ends of the bus bars 33 are provided with connectors 33A and 33B for the P-N terminals 22A and 22B of the power board 21A, connectors 33C and 33D for the two terminals 23A and 23B of the smoothing capacitor 23, connectors 33E and 33F for the two enameled wires 24A and 24B of the inductor coil 24, and connectors 33I and 33J for the two downstream-side enameled wires 30C and 30D of the common mode coil 30, and the ends of the bus bars 33 that are connected to the terminal block 26 are provided with connectors 33G and 33H connected with the two upstream-side enameled wires 30A and 30B of the common mode coil 30.

Of the aforementioned connectors 33A to 33J, the connectors 33E and 33F for the two enameled wires 24A and 24B of the inductor coil 24 and the connectors 33G, 33H, 33I, and 33J for the four enameled wires 30A to 30D of the common mode coil 30 are respectively equipped with tubular segments for retaining the enameled wires 24A and 24B and the enameled wires 30A to 30D by inserting the ends thereof into the corresponding tubular segments.

Furthermore, in the aforementioned bus bar assembly 32, the bus bars 33 that connect the two terminals 23A and 23B of the smoothing capacitor 23 to the P-N terminals 22A and 22B of the power board 21A are routed so as to allow for a connection with a minimal distance therebetween. To make such routing possible, the smoothing capacitor 23 is disposed on extension lines of the two P-N terminals 22A and 22B provided in the power board 21A, and the bus bar assembly 32 is disposed so that the aforementioned bus bars 33 are routed with a minimal distance along these extension lines.

With the configuration described above, the present embodiment can provide the following advantages.

High-voltage direct-current power supplied to the electric compressor 1 from a power-supply unit mounted in a vehicle via a high-voltage cable is input from the connector 27 to the terminal block 26 via the high-voltage cables 28 and 29. This direct-current power flows to the common mode coil 30 via the bus bars 33 connected to the terminal block 26 and then travels sequentially through the inductor coil 24 and the smoothing capacitor 23 connected to each other via the bus bar assembly 32 so as to enter the P-N terminals 22A and 22B of the power board 21A. During this time, common mode noise, switching noise, and current ripple are reduced by the common mode coil 30, the inductor coil 24, and the smoothing capacitor 23.

The direct-current power input to the P-N terminals 22A and 22B of the power board 21A is converted to three-phase alternating-current power with a command frequency by a switching operation of the semiconductor switching devices on the power board 21A controlled on the basis of a command signal sent to the CPU board 21B from a higher-level control apparatus (not shown). This three-phase alternating-current power is fed from the U-V-W terminals provided in the power board 21A to the electric motor inside the cylindrical housing 2 via the glass-sealed terminals. In consequence, the electric motor is rotationally driven based on the command frequency, whereby the compression mechanism is actuated.

The operation of the compression mechanism causes low-temperature refrigerant gas to be taken into the cylindrical housing (motor housing) 2 through the refrigerant intake port. This refrigerant flows in the motor-shaft direction around the electric motor so as to be taken into the compression mechanism where the refrigerant is compressed to a high-temperature high-pressure state, and is then discharged into the cylindrical housing (compressor housing) 2. This high-pressure refrigerant is delivered outward from the electric compressor 1 through the discharge port. During this time, the low-temperature low-pressure refrigerant gas taken into the cylindrical housing (motor housing) 2 at one end thereof through the refrigerant intake port and flowing in the motor-shaft direction travels along a motor-housing wall so as to forcedly cool high-voltage heat-generating components, such as the semiconductor switching devices (IGBTs), installed on the installation surfaces 6 within the inverter accommodating section 4.

Similarly, high-voltage components such as the smoothing capacitor 23, the inductor coil 24, and the common mode coil 30 disposed within the high-voltage-component installation site 10 and the coil installation site 12 extending from one end surface of the cylindrical housing (motor housing) 2 and connected with the housing wall thereof can be cooled by transmitting the cooling energy of the intake refrigerant gas. With the layout design in which the high-voltage heat-generating components, such as the semiconductor switching devices (IGBTs), the smoothing capacitor 23, the inductor coil 24, and the common mode coil 30, are disposed along the housing wall of the cylindrical housing (motor housing) 2, which is configured to take in low-temperature refrigerant gas, the cooling effect by the refrigerant on the high-voltage heat-generating components can be enhanced.

Accordingly, the heat-resisting performance of the high-voltage heat-generating components within the inverter device 20 is enhanced, thereby minimizing performance degradation.

Furthermore, in providing the common mode coil 30 in order to reduce common mode noise in the aforementioned inverter device 20, the coil installation site 12 is provided below the terminal-block installation site 11 provided at one side of the outward extending portion 9 of the inverter accommodating section 4, and the common mode coil 30 is installed in this coil installation site 12. This means that the common mode coil 30 and the terminal block 26 are disposed at two levels in the vertical direction. Therefore, even in the case where a common mode coil 30 is provided for reducing common mode noise of an inverter, the common mode coil 30 can be added without having to increase the planar area for the inverter accommodating section 4, while maintaining the same planar area of the inverter accommodating section 4 as that when accommodating an inverter device including the inverter board 21, the smoothing capacitor 23, the inductor coil 24, and the terminal block 26.

Accordingly, in addition to achieving high performance of the inverter device 20 by reducing common mode noise, size reduction and compactness of the inverter accommodating section 4 containing the inverter device 20 are also achieved, thereby enhancing the mountability of the integrated-inverter electric compressor 1. In particular, since the terminal block 26 and the common mode coil 30 are disposed at two levels in the vertical direction in the terminal-block installation site 11 and the coil installation site 12, respectively, the common mode coil 30 can be installed within a projection area of the terminal-block installation site 11 since there is no significant difference in planar dimensions between the terminal block 26 and the common mode coil 30. In consequence, the planar area of the inverter accommodating section 4 can be made substantially the same regardless of the presence or absence of the common mode coil 30, and can thus be minimized.

Of the smoothing capacitor 23 and the inductor coil 24 disposed along one end of the cylindrical housing 2, the terminal-block installation site 11 and the coil installation site 12 are provided at one side of the high-voltage-component installation site 10 that is adjacent to the smoothing capacitor 23. For this reason, the bus bar assembly 32 used for implementing electrical wiring between the electrical components, i.e., the common mode coil 30, the inductor coil 24, the smoothing capacitor 23, and the inverter board 21 connected with the high-voltage lines in that order in the downstream direction from the terminal block 26, can have a simple L-shaped configuration. Thus, the installation space of the bus bar assembly 32 can be minimized, thereby achieving size reduction and compactness of the inverter device 20 and the accommodating section 4 therefor.

Furthermore, the common mode coil 30 is disposed such that, of the four enameled wires 30A to 30D extending from the coil, the two upstream-side wires 30A and 30B are routed vertically along one side of the terminal block 26, whereas the two downstream-side wires 30C and 30D are routed vertically along the other side, and the enameled wires 30A to 30D are connected between two of the bus bars 33 that are connected to the terminal block 26. Therefore, the four enameled wires 30A to 30D extending from the common mode coil 30 can be connected between the two bus bars 33 by simply extending the four enameled wires 30A to 30D upward along both sides of the terminal block 26. This facilitates routing of the four enameled wires 30A to 30D, as well as welding to the bus bars 33, thereby allowing for improved assembly and productivity.

Because the bus bars 33 of the bus bar assembly 32 connected to the inductor coil 24 and the common mode coil 30 are provided with connectors 33E to 33J equipped with tubular segments for retaining the ends of the enameled wires 24A and 24B and 30A to 30D extending from the inductor coil 24 and the common mode coil 30, respectively, when the enameled wires 24A and 24B and 30A to 30D are to be welded to the bus bars 33, the ends of the enameled wires 24A and 24B and 30A to 30D can be securely positioned by being inserted into the tubular segments of the connectors 33E to 33J. This allows for reduction of guiding components for the ends of the enameled wires, as well as enhancement in positioning accuracy of welding points where the enameled wires 24A and 24B and 30A to 30D are welded to the bus bars 33. Accordingly, welding workability is improved and the weld quality and weld strength are also improved, thereby increasing product quality and reliability.

The connectors 33E to 33J do not necessarily need to be configured to have the tubular segments and may alternatively be configured to have semicircular or U-shaped engagement segments so long as the connectors have a structure that allows for retaining and secure positioning of the ends of the enameled wires 24A and 24B and the enameled wires 30A to 30D, or may have a structure in which the ends can be temporarily fastened by caulking in addition to simply retaining the ends; in that case, the welding accuracy can be further enhanced.

In the high-voltage-component installation site 10, the smoothing capacitor 23 is disposed on the extension lines of the P-N terminals 22A and 22B provided at one side of the inverter board 21 (power board 21A). Therefore, by disposing the bus bars 33 of the bus bar assembly 32 that connect between the smoothing capacitor 23 and the P-N terminals 22A and 22B on the aforementioned extension lines, the bus bars 33 can be routed with a minimal distance. Accordingly, current ripple in the inverter device 20 can be reduced as much as possible, thereby minimizing voltage fluctuations and the like and stabilizing the performance of the inverter device 20.

The present invention is not limited to the invention according to the above embodiment, and suitable modifications are permissible within a scope not departing from the spirit of the invention. For example, in the above embodiment, the compression mechanism of the integrated-inverter electric compressor 1 may be of any type. Moreover, the inverter device 20 may include other electrical components so long as the device includes at least the inverter board 21, the smoothing capacitor 23, the inductor coil 24, the terminal block 26, and the common mode coil 30. Furthermore, although the above description is directed to an example in which the inverter board 21 includes two boards, i.e., the power board 21A and the CPU board 21B, an inverter board formed by integrating these boards into a single module may be used as an alternative.

The invention claimed is:

1. An integrated-inverter electric compressor in which an inverter accommodating section is provided on an outer periphery of a cylindrical housing containing an electric motor and a compression mechanism, and the inverter accommodating section accommodates an inverter device that includes high-voltage components, including an inverter board, a smoothing capacitor, an inductor coil, and a common mode coil; a terminal block connected with a high-voltage cable; and a bus bar assembly including a plurality of bus bars for electrical wiring between these electrical components, wherein the inverter accommodating section is provided with an outward extending portion extending outward from one end of the cylindrical housing, and wherein the terminal block is disposed at one side of the outward extending portion, and a coil installation site, where the common mode coil is disposed, is formed integrally with the outward extending portion and extends downward below the entire terminal block.

2. An integrated-inverter electric compressor in which an inverter accommodating section is provided on an outer periphery of a cylindrical housing containing an electric motor and a compression mechanism, and the inverter accommodating section accommodates an inverter device that includes high-voltage components, including an inverter board, a smoothing capacitor, an inductor coil, and a common mode coil; a terminal block connected with a high-voltage cable; and a bus bar assembly including a plurality of bus bars for electrical wiring between these electrical components, wherein the inverter accommodating section is provided with an outward extending portion extending outward from one end of the cylindrical housing, and wherein an area in the inverter accommodating section that corresponds to the outer periphery of the cylindrical housing serves as an installation site for the inverter board, and the outward extending portion serves as a high-voltage-component installation site where the smoothing capacitor and the inductor coil are disposed, and wherein one side of the high-voltage-component installation site in the outward extending portion is designated as an installation site for the terminal block, and a coil installation site where the common mode coil is disposed is formed below the entire terminal-block installation site.

3. The integrated-inverter electric compressor according to claim 2, wherein, of the smoothing capacitor and the inductor coil disposed along one end of the cylindrical housing, the terminal-block installation site and the coil installation site are provided at one side of the high-voltage-component installation site that is adjacent to the smoothing capacitor.

4. The integrated-inverter electric compressor according to claim 2, wherein the terminal block and the common mode coil are disposed at two levels in the vertical direction in the terminal-block installation site and the coil installation site.

5. The integrated-inverter electric compressor according to claim 2, wherein the common mode coil is disposed such that, of four enameled wires extending from the coil, two of the enameled wires on an upstream side are routed vertically along one side of the terminal block, and two of the enameled wires on a downstream side are routed vertically along another side of the terminal block, and each enameled wire is connected between two of the bus bars connected to the terminal block.

6. The integrated-inverter electric compressor according to claim 2, wherein ends of the bus bars of the bus bar assembly are provided with connectors that retain ends of enameled wires extending from the inductor coil and the common mode coil.

7. The integrated-inverter electric compressor according to claim 2, wherein, in the high-voltage-component installation site, the smoothing capacitor is disposed on an extension line of a P-N terminal provided at one side of the inverter board, and wherein a bus bar of the bus bar assembly that connects between the smoothing capacitor and the P-N terminal is disposed with a minimal distance along the extension line.

8. The integrated-inverter electric compressor according to claim 2, wherein the one end of the cylindrical housing is provided with a refrigerant intake port, and wherein the high-voltage component installation site and the coil installation site are at least partially connected to a surface of the one end of the cylindrical housing provided with the refrigerant intake port.

9. An integrated-inverter electric compressor in which an inverter accommodating section is provided on an outer periphery of a cylindrical housing containing an electric motor and a compression mechanism, and the inverter accommodating section accommodates an inverter device that includes high-voltage components, including an inverter board, a smoothing capacitor, an inductor coil, and a common mode coil; a terminal block connected with a high-voltage cable; and a bus bar assembly including a plurality of bus bars for electrical wiring between these electrical components, wherein the inverter accommodating section is provided with an outward extending portion extending outward from one end of the cylindrical housing, and wherein the terminal block is disposed at one side of the outward extending portion, and a coil installation site, where the common mode coil is disposed, is formed integrally with the outward extending portion and extends downward below the terminal block, wherein, of the smoothing capacitor and the inductor coil disposed along one interior end of the cylindrical housing, the terminal-block installation site and the coil installation site are provided at one side of the high-voltage-component installation site that is adjacent to the smoothing capacitor, and wherein the common mode coil is disposed such that, of four enameled wires extending from the coil, two of the enameled wires on an upstream side are routed vertically along one side of the terminal block, and two of the enameled wires on a downstream side are routed vertically along another side of the terminal block, and each enameled wire is connected between two of the bus bars connected to the terminal block.

10. An integrated-inverter electric compressor in which an inverter accommodating section is provided on an outer periphery of a cylindrical housing containing an electric motor and a compression mechanism, and the inverter accommodating section accommodates an inverter device that includes high-voltage components, including an inverter board, a smoothing capacitor, an inductor coil, and a common mode coil; a terminal block connected with a high-voltage cable; and a bus bar assembly including a plurality of bus bars for electrical wiring between these electrical components, wherein the inverter accommodating section is provided with an outward extending portion extending outward from one end of the cylindrical housing, and wherein an area in the inverter accommodating section that corresponds to the outer periphery of the cylindrical housing serves as an installation site for the inverter board, and the outward extending portion serves as a high-voltage-component installation site where the smoothing capacitor and the inductor coil are disposed, wherein one side of the high-voltage-component installation site in the outward extending portion is designated as an installation site for the terminal block, and a coil installation site where the common mode coil is disposed is formed below the terminal-block installation site, wherein, of the smoothing capacitor and the inductor coil disposed along one interior end of the cylindrical housing, the terminal-block installation site and the coil installation site are provided at one side of the high-voltage-component installation site that is adjacent to the smoothing capacitor, and wherein the common mode coil is disposed such that, of four enameled wires extending from the coil, two of the enameled wires on an upstream side are routed vertically along one side of the terminal block, and two of the enameled wires on a downstream side are routed vertically along another side of the terminal block, and each enameled wire is connected between two of the bus bars connected to the terminal block.

11. The integrated-inverter electric compressor according to claim 10, wherein the terminal block and the common mode coil are disposed at two levels in the vertical direction in the terminal-block installation site and the coil installation site.

12. The integrated-inverter electric compressor according to claim 10, wherein ends of the bus bars of the bus bar assembly are provided with connectors that retain ends of enameled wires extending from the inductor coil and the common mode coil.

13. The integrated-inverter electric compressor according to claim 10, wherein, in the high-voltage-component installation site, the smoothing capacitor is disposed on an extension line of a P-N terminal provided at one side of the inverter board, and wherein a bus bar of the bus bar assembly that connects between the smoothing capacitor and the P-N terminal is disposed with a minimal distance along the extension line.

14. The integrated-inverter electric compressor according to claim 10, wherein the one end of the cylindrical housing is provided with a refrigerant intake port, and wherein the high-voltage component installation site and the coil installation site are at least partially connected to a surface of the one end of the cylindrical housing provided with the refrigerant intake port.

* * * * *